US006626142B2

(12) United States Patent
Tokiya et al.

(10) Patent No.: US 6,626,142 B2
(45) Date of Patent: Sep. 30, 2003

(54) INTAKE AIR RATE CONTROLLING DEVICE FOR AN INTERNAL COMBUSTION ENGINE

(75) Inventors: Satoru Tokiya, Tokyo (JP); Kenji Nakao, Tokyo (JP); Teruhiko Moriguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 26 days.

(21) Appl. No.: 09/907,669

(22) Filed: Jul. 19, 2001

(65) Prior Publication Data

US 2002/0179046 A1 Dec. 5, 2002

(30) Foreign Application Priority Data

May 30, 2001 (JP) ..... 2001-162561

(51) Int. Cl.[7] ..... F02D 9/10
(52) U.S. Cl. ..... 123/337; 123/399
(58) Field of Search ..... 123/336, 337, 123/361, 399, 350

(56) References Cited

U.S. PATENT DOCUMENTS 5,921,217 A * 7/1999 Koike et al. ..... 123/335
6,003,490 A * 12/1999 Kihara et al. ..... 123/337
6,158,414 A * 12/2000 Ma ..... 123/336
6,189,505 B1 * 2/2001 Reid ..... 123/336
6,349,699 B1 * 2/2002 Wild et al. ..... 123/336
6,354,284 B1 * 3/2002 Nakano et al. ..... 123/591

FOREIGN PATENT DOCUMENTS

JP 2000-291452 10/2000

* cited by examiner

*Primary Examiner*—John Kwon
(74) *Attorney, Agent, or Firm*—Sughrue Mion, PLLC

(57) ABSTRACT

In an intake air rate controlling device including a throttle body, forming an air-intake passage, and a plate-like throttle valve, rotatably supported by the throttle body through a throttle shaft, wherein an intake air rate supplied to an internal combustion engine is controlled by a rotation of the throttle valve, and air-flow controlling means is located on an upper stream side or a lower stream side of the throttle valve for suppressing a variation of a torque, effecting on the throttle valve by a hydrodynamic force generated by an intake air, whereby excellent durability, excellent reliability, and high performances are obtainable.

6 Claims, 4 Drawing Sheets

VIEWED IN DIRECTION A

RELATIONSHIP AMONG OPENING DEGREE, AIR FLOW RATE, AND HYDRODYNAMIC FORCE

INTAKE AIR RATE CONTROLLING DEVICE FOR AN INTERNAL COMBUSTION ENGINE

BACKGROUND OF THE INVENTION

1. Field of the Invention

The present invention relates to an intake air rate controlling device for an internal combustion engine, which controls an intake air rate in response to driving conditions of a vehicle.

2. Discussion of Background

A throttle valve for an internal combustion engine for a vehicle is located in an air-intake passage of a throttle body, is opened and closed in proportional to a degree of operating an accelerator, and is operated upon a state of the vehicle, for example a detection of slippage and so on, as a rotational difference between a front wheel and a rear wheel, whereby the throttle valve controls an output of the internal combustion engine by controlling the intake air rate. Therefore, a structure for opening and closing the throttle valve is not such that the throttle valve is directly connected to an accelerator pedal and a linkage mechanism. Opening and closing positions of the throttle valve are operated by a motor and so on, and determined by a composite signal including a signal of an amount of operating the accelerator.

FIG. 4 illustrates a structure of a conventional intake air rate controlling device of an internal combustion engine. FIG. 5 is a cross-sectional view of the intake air rate controlling device illustrated in FIG. 4 in an axis direction of a throttle body. In the figures, numerical reference 1 designates the throttle body forming the air-intake passage 2, connected to an intake pipe (not shown) of the internal combustion engine. Numerical reference 4 designates a throttle valve substantially shaped like a plate, which is positioned in the throttle body 1 through a throttle shaft 3, supported by bearings 5 and 6, so as to be freely rotatable. The throttle valve 4 is constructed such that the intake air rate is controlled such that a passage area of the air-intake passage 2 is increased and decreased by a rotation, e.g. in a counter-clockwise direction in this figure, of the throttle shaft 3.

Numerical reference 7 designates a motor (a detailed structure inside the motor is omitted) for opening and closing the throttle valve. A motor shaft 8 is fixed to the motor, and a motor gear 9 is fixed to the motor shaft 8. The motor gear 9 is engaged with a reduction gear 11, supported by a pin 10 fixed to the throttle body 1, and the reduction gear 11 is further engaged with a throttle gear 12, which is fixed to an end of the throttle shaft 3, whereby a driving force of the motor 7 is transmitted to the throttle shaft 3. Numerical reference 13 designates a spring, engaged with the motor gear 9. The throttle valve 4 is stopped to have a low opening degree by a working torque of the spring 13.

Numerical reference 14 designates a rotor, fixed to an end of the throttle shaft 3. Numerical reference 15 designates a contactor, formed in the rotor 14. Numerical reference 16 designates a variable resistor for detecting a rotational angle of the throttle shaft 3. Numerical reference 17 designates a cover for fixing the variable resistor 16. An intake air supplied to the internal combustion engine flows through the air-intake passage 2 from a right hand to a left hand on a paper face of the FIG. 5 like narrow arrows.

In the next, an operation will be described, when a current is applied to the motor 7, the motor shaft 8 is rotated to drive the motor gear 9, the reduction gear 11, and the throttle gear 12, whereby the throttle shaft 3 is rotated. By the rotation of the contactor 15, located in the rotor 14, on the variable resistor 16, the rotational angle of the throttle shaft 3 is detected as an output value. To bring the output value from the variable resistor 16 to a target value, the current to the motor 7 is controlled in use of a control device (not shown) so that a torque of the motor 7 is in proportional to the working torque of the spring 13, and the angle of the throttle shaft 3 is controlled.

However, in the conventional intake air controlling device for the combustion engine, when a high rate of an air flows into the air-intake passage 2 under a state that the opening degree of the throttle valve 4 is large, in other words, a state that the throttle valve 4 is opened to have a small angle from a horizontal line, as illustrated in FIG. 5, a torque designated by a wide arrow in FIG. 5 is applied to the throttle valve 4 so as to close the throttle shaft 3 by a hydrodynamic force of the intake air. Because the throttle valve 4 is positioned in a flow of the intake air to have the small angle from the horizontal line, a difference of flow rate between an air flowing below the throttle valve 4 and an air flowing above the throttle valve 4 is caused in a manner similar to a principle of fly of airplanes, and a torque in a direction of closing the throttle valve 4 is applied to the throttle valve 4 by a pressure caused by the flowing rate difference.

Since the opening degree of the throttle shaft 3 is maintained by a balance between the torque by the spring 13 and the torque transmitted to the throttle shaft 3 from the motor 7 in the conventional intake air controlling device of the internal combustion engine, when the intake air rate has a pulse beat, the torque applied to the throttle valve 4 is largely varied by a variation of the hydrodynamic force, caused by a variation of a flowing rate.

On the other hand, as illustrated in FIG. 6, when the throttle valve 4 is positioned in parallel to a flow of the intake air, in other words the throttle valve 4 is fully opened, a torque applied to the throttle valve 4 becomes substantially zero. Accordingly, if the throttle valve 4 is moved little by any external force, a variation of the torque caused by the variation is also increased.

As described, there are problems that durability, reliability, and performances of the intake air controlling device are deteriorated by a large variation of the torque, applied to the throttle valve 4, as an outer disturbance in controlling the position of the throttle valve 4.

SUMMARY OF THE INVENTION

It is an object of the present invention to solve the above-mentioned problems inherent in the conventional technique and to provide an intake air rate controlling device, which can suppress a torque variation applied to its throttle valve, caused by a hydrodynamic force of an intake air, and has excellent durability, excellent reliability, and high performances.

According to a first aspect of the present invention, there is provided an intake air rate controlling device for an internal combustion engine comprising: a throttle body forming an air-intake passage, connected to an intake pipe of the internal combustion engine; and a throttle valve in a plate-like shape, supported to the throttle body through a throttle shaft so as to be rotatable, wherein an air-intake rate, supplied to the internal combustion engine, is controlled by a rotation of the throttle valve, wherein the intake air rate controlling device further comprising an air-flow controlling means for suppressing a variation of a torque caused by a hydrodynamic force generated by an intake air and working on the throttle valve.

According to a second aspect of the present invention, there is provided the intake air rate controlling device, wherein the air-flow controlling means is located within an area of the height of the throttle shaft.

According to a third aspect of the present invention, there is provided the intake air rate controlling device, wherein the air-flow controlling means is shaped like a wing having a slant with respect to an axis line of the throttle body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

A detailed explanation will be given of preferred embodiments of the present invention in reference to FIGS. 1 through 6 as follows, wherein the same numerical references are used for the same or similar portions and descriptions of these portions is omitted.

EMBODIMENT 1

Figure 1:
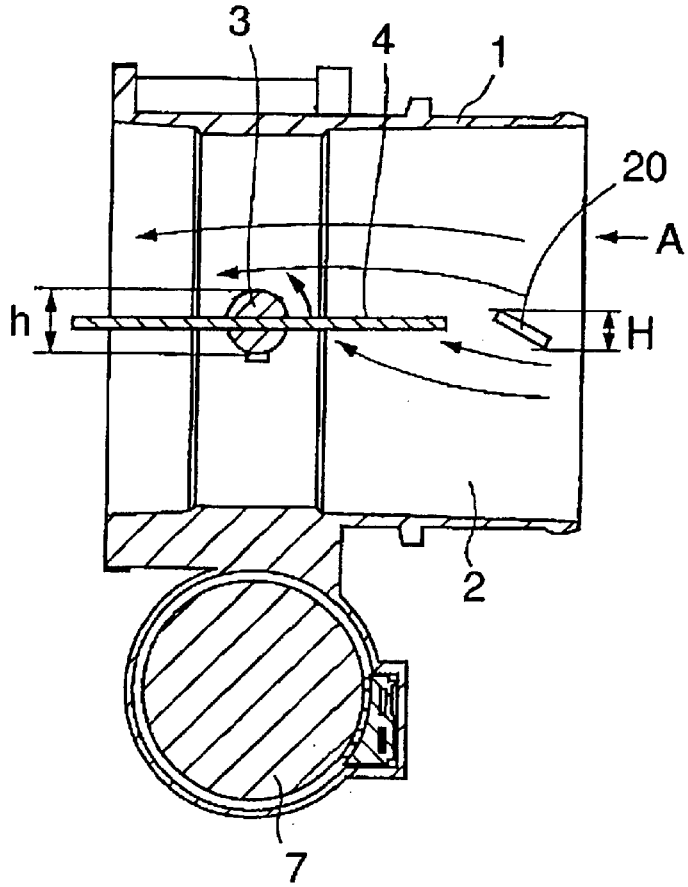
FIG. 1 is a cross-sectional view illustrating an intake air rate controlling device for an internal combustion engine according to an embodiment of the present invention.
Figure 2:
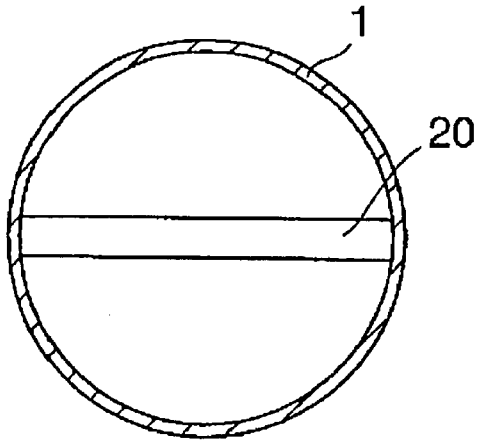
FIG. 2 is a cross-sectional view illustrating the intake air rate controlling device for the internal combustion engine according to the embodiment of the present invention.

FIG. 1 is a cross-sectional view illustrating an intake air rate controlling device for an internal combustion engine according to this embodiment. FIG. 2 is a cross-sectional view of a throttle body in a radial direction viewed in a direction of an arrow A of FIG. 1. Same numerical references are used for portions same as or similar to those in the conventional technique. In the figures, numerical reference 1 designates the throttle body forming an air-intake passage 2, connected to an intake pipe (not shown) of the internal combustion engine. Numerical reference 4 designates a throttle valve substantially shaped like a plate, which is located through a throttle shaft 3, supported by bearings (not shown), which is located in the throttle body so as to be freely rotatable. The throttle valve 4 is constructed to control an intake air rate by an increment and a decrement of a cross-sectional area of the air-intake passage 2 upon a rotation, for example, in a counter-clockwise direction, of the throttle shaft 3, wherein this structure is similar to that in the conventional technique. A structure that the throttle shaft 3 is rotated is similar to a driving system of the conventional technique illustrated in FIG. 4. An intake air, supplied to the internal combustion engine, flows from a right hand to a left hand of the air-intake passage 2 like narrow arrows on a paper face of FIG. 1.

In this embodiment, an air-flow controlling means is used for controlling an intake air flowing into the air-intake passage 2 and for suppressing a variation of a torque like a wide arrow in FIG. 1, which torque works on the throttle valve 4 by a hydrodynamic force, generated by the intake air, so as to close the throttle shaft 3, wherein the means is a current plate 20. The current plate 20 is located inside the air-intake passage 2. The current plate 20 is monolithically formed with the throttle body 1, made of, for example, a molded component of aluminum die cast, and is located on an upper stream side of the throttle valve 4.

The current plate 20 is located in an area within the height H of the throttle shaft 3 as illustrated in FIG. 1. The intake air rate is determined by an opening area of the air-intake passage 2, wherein the opening area is obtained by subtracting a cross-sectional area of the throttle shaft 3 from a cross-sectional area of the air-intake passage 2. Accordingly, when the height H of the current plate 20 is within the height h, i.e. a diameter because the throttle shaft 3 is a cylindrical shape in FIG. 1, of the throttle shaft 3, the opening area is not changed even though the current plate 20 is located inside the air-intake passage 2, whereby the intake air rate is not changed.

Further, the current plate 20 is shaped like a wing slanted with respect to an axis of the throttle body 1. Therefore, it is possible to improve an effect of controlling an intake air and to effectively suppress a variation of the torque of the throttle valve 4. As illustrated in FIG. 1, when the intake air flows from a right hand to a left hand on the paper face and the throttle valve 4 is rotated in a counter-clockwise direction, the slanted current plate 20, positioned lower on an upper stream side and higher on a lower stream side, can provide a predetermined effect of controlling the air flow. Further, when the throttle valve 4 is rotated in the clockwise direction by a flow of the intake air from the right hand to the left hand on the paper face, the slanted current plate 20, positioned higher on the upper stream side and lower on the lower stream side, can provide the predetermined effect of controlling the air flow.

Figure 3:
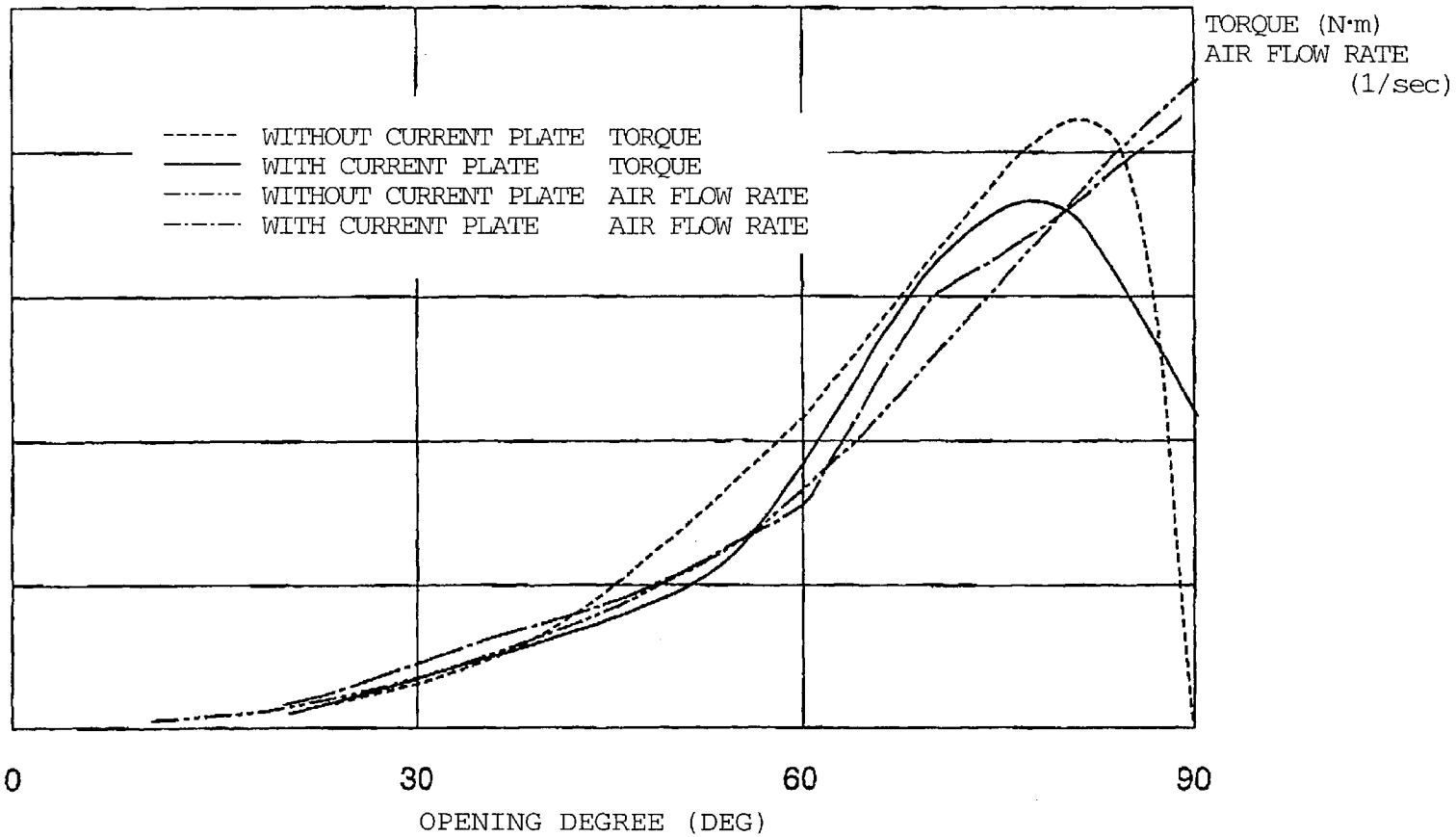
FIG. 3 is a view for explaining a comparison between the intake air rate controlling device for the internal combustion engine according to the embodiment of the present invention and the conventional intake air rate controlling device for the internal combustion engine.
Figure 4:
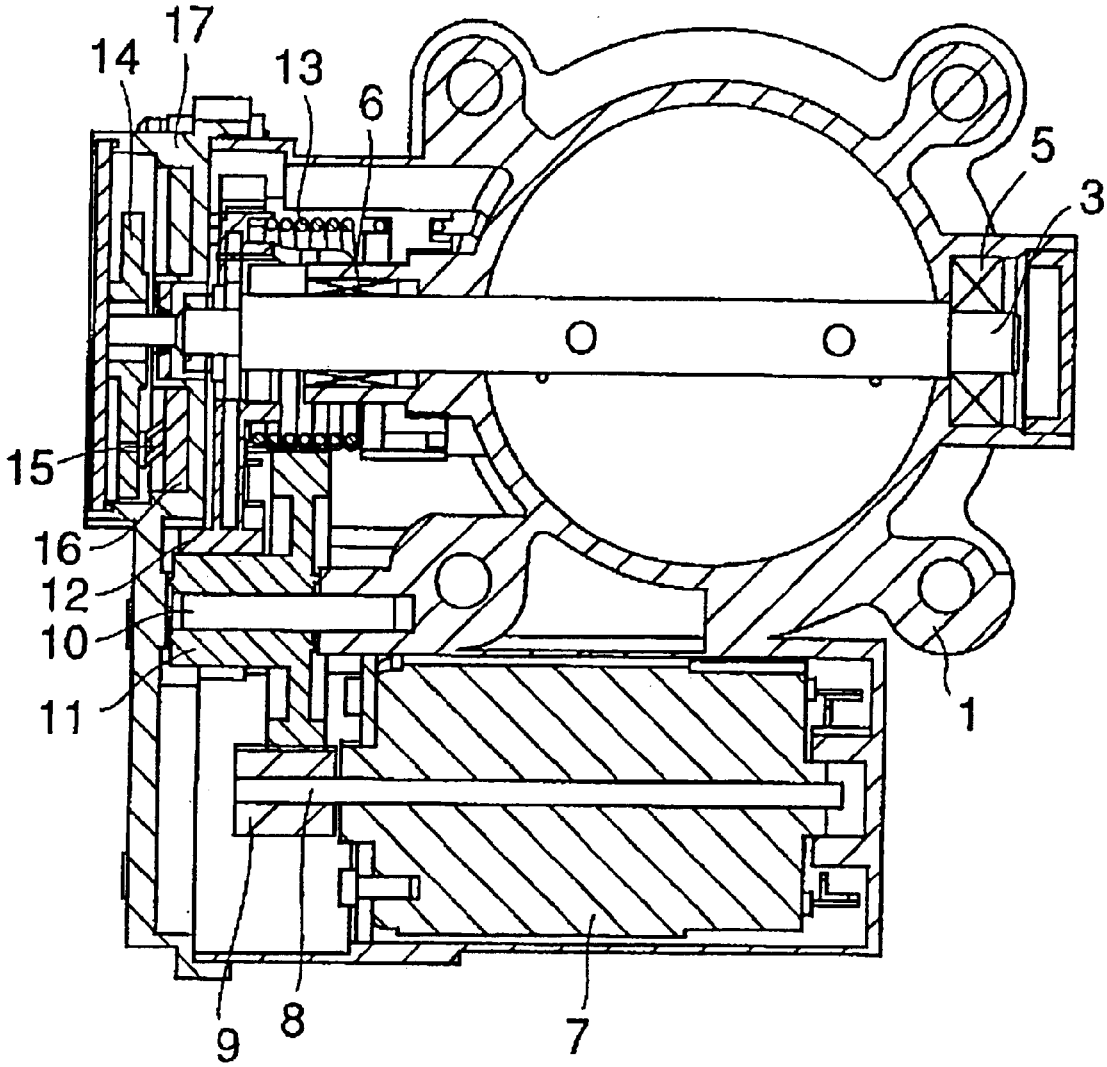
FIG. 4 illustrates a structure of the conventional intake air rate controlling device for the internal combustion engine.
Figure 5:
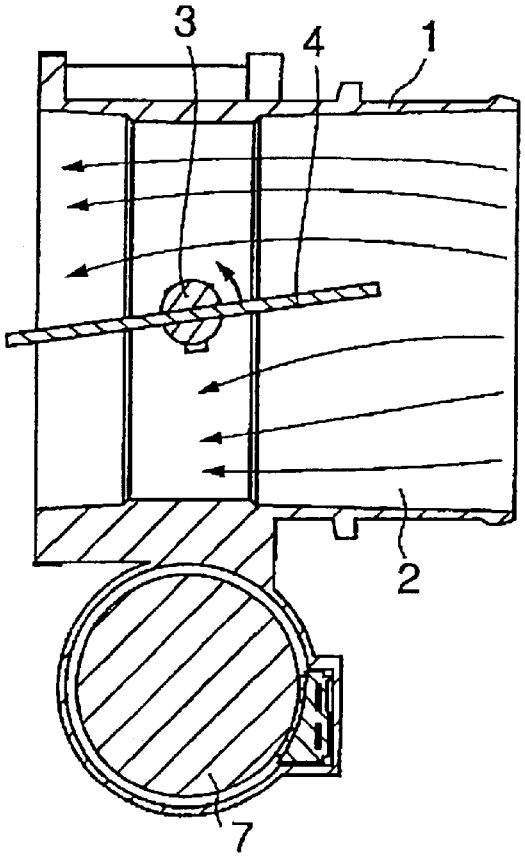
FIG. 5 is a cross-sectional view illustrating the conventional intake air rate controlling device for the internal combustion engine.
Figure 6:
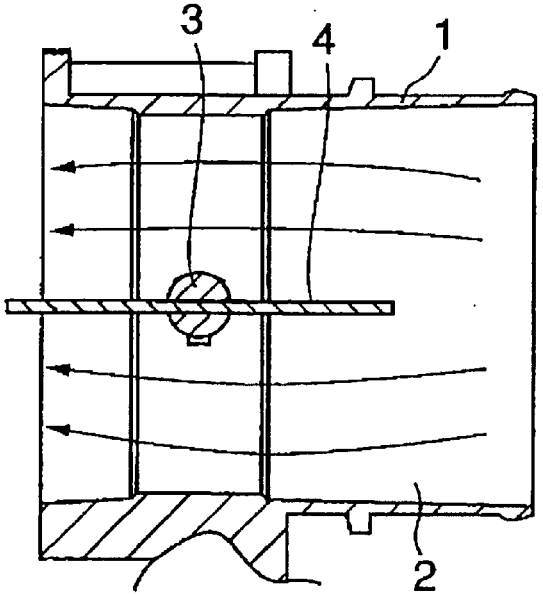
FIG. 6 is a cross-sectional view illustrating the conventional intake air rate controlling device for the internal combustion engine.

FIG. 3 is a graph illustrating a comparison between the intake air controlling device of the internal combustion engine and the conventional intake air controlling device for the internal combustion engine, wherein flow rates per opening degrees of the throttle valve 4 and torques effecting on the throttle valve 4 are compared. In FIG. 3, an abscissa represents an opening degree (deg) of the throttle valve 4, and an ordinate represents a flow rate (1/sec) of the intake air to the air-intake passage 2 and a torque (N·m) effecting on the throttle valve 4. Further, a solid line designates a torque characteristic according to this embodiment, in which the current plate 20 is used, and a broken line designates a torque characteristic in the conventional technique without the current plate 20. A chain line designates an air-flow rate characteristic according to this embodiment using the current plate 20, and a chain double-dashed line designates an air-flow rate characteristic without the current plate 20.

As illustrated in FIG. 3, the flow rate is increased as the opening degree is increased. However, there is almost no difference between the air-flow rates in the conventional technique and this embodiment. Therefore, an existence of the current plate 20 scarcely affects the opening area of the air-intake passage 2. On the other hand, the torques effecting on the throttle valve 4 show different characteristics between the cases with and without the current plate 20. In the conventional technique without using the current plate 20, because the torque becomes zero when the throttle valve 4 is completely opened by 90°, the torque in the vicinity of a completely opened state shows an abrupt change because the torque becomes zero. However, in this embodiment using the current plate 20, the hydrodynamic force in the vicinity of the completely opened state shows a calm change because the torque in the completely opened state of the throttle valve 4 is kept.

Accordingly, in the intake air-flow controlling device according to this embodiment using the current plate 20, the torque is effecting on the throttle valve 4 even when the throttle valve 4 is completely opened, and a variation of the torque in the vicinity of the completely opened state, in which the throttle valve 4 is slightly closed. Therefore, elements of an outer disturbance in controlling the position of the throttle valve 4 are reduced, and it is possible to obtain the intake air rate controlling device for the internal combustion engine having excellent durability, excellent reliability, and high performances is obtainable.

Although, in this embodiment, an example that the current plate 20 is located on the upper stream side of the throttle valve 4 is described. However, effects similar to those described above are obtainable even when the current plate 20 is located on the lower stream side of the throttle valve 4. In this case, when the intake air flows from the right hand to the left hand on the paper face of FIG. 1, and the throttle valve 4 is rotated in the counter-clockwise direction, the slanted current plate 20 is positioned higher on the upper stream side and lower on the lower stream side, whereby a predetermined effect is obtainable. On the other hand, when the throttle valve is rotated in the clockwise direction, the slanted current plate 20 is positioned lower on the upper stream side and higher on the lower stream side, whereby the predetermined effect is obtainable.

The first advantage of the intake air rate controlling device according to the present invention is that outer disturbances in controlling the position of the throttle valve can be reduced, whereby excellent durability, excellent reliability and high performances are obtainable.

The second advantage of the intake air rate controlling device according to the present invention is that the intake air rate is not changed when the air-flow controlling means is located inside the air-intake passage, whereby excellent durability, excellent reliability and high performances are obtainable.

The third advantage of the air-flow rate controlling device according to the present invention is that an effect of controlling the air flow is improved because the slanted wing-like intake air controlling means is used, whereby an effect of restricting a variation of a torque, effecting on the throttle valve, is obtainable.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application No. 2001-162561 filed on May 30, 2001 including specification, claims, drawings and summary are incorporated herein by reference in its entirety.

What is claimed is:

1. An intake air rate controlling device for an internal combustion engine comprising:

a throttle body forming an air-intake passage, connected to an intake pipe of the internal combustion engine; and a throttle valve in a plate-like shape, supported to the throttle body through a throttle shaft so as to be rotatable, wherein an intake air rate, supplied to the internal combustion engine, is controlled by a rotation of the throttle valve, wherein the intake air rate controlling device further comprising an air-flow controlling means for suppressing a variation of a torque, caused by a hydrodynamic force, generated by the intake air and working on the throttle valve.

2. The intake air rate controlling device according to claim 1, wherein the air-flow controlling means is located within an area of the height of the throttle shaft.

3. The intake air rate controlling device according to claim 1, wherein the air-flow controlling means is shaped like a wing, slanted with respect to an axis of the throttle body.

4. The intake air rate controlling device according to claim 2, wherein the air-flow controlling means is shaped like a wing, slanted with respect to an axis of the throttle body.

5. The intake air rate controlling device according to claim 1, wherein the air-flow controlling means is a current plate.

6. The intake air rate controlling device according to claim 1, wherein the air-flow controlling means is disposed upstream of the throttle valve with respect to a flow of the intake air.

* * * * *